US010361049B2

(12) United States Patent
Kohinata et al.

(10) Patent No.: US 10,361,049 B2
(45) Date of Patent: Jul. 23, 2019

(54) ELECTROMAGNETIC RELAY

(71) Applicant: FUJITSU COMPONENT LIMITED, Tokyo (JP)

(72) Inventors: Hiroaki Kohinata, Tokyo (JP); Yusuke Uchiyama, Tokyo (JP); Koyuru Kobayashi, Tokyo (JP); Satoshi Takano, Tokyo (JP)

(73) Assignee: FUJITSU COMPONENT LIMITED, Tokyo (JP)

( * ) Notice: Subject to any disclaimer, the term of this patent is extended or adjusted under 35 U.S.C. 154(b) by 0 days.

(21) Appl. No.: 15/619,660

(22) Filed: Jun. 12, 2017

(65) Prior Publication Data

US 2018/0012717 A1 Jan. 11, 2018

(30) Foreign Application Priority Data

Jul. 5, 2016 (JP) ..... 2016-133523

(51) Int. Cl.

| | |
|---|---|
| ***H01H 51/22*** | (2006.01) |
| ***H01H 45/10*** | (2006.01) |
| ***H01H 45/02*** | (2006.01) |
| ***H01H 50/04*** | (2006.01) |
| ***H01H 50/18*** | (2006.01) |
| ***H01H 50/32*** | (2006.01) |
| ***H01H 50/56*** | (2006.01) |
| ***H01H 50/58*** | (2006.01) |

(Continued)

(52) U.S. Cl.

CPC ..... *H01H 45/10* (2013.01); *H01H 45/02* (2013.01); *H01H 50/041* (2013.01); *H01H 50/18* (2013.01); *H01H 50/321* (2013.01); *H01H 50/56* (2013.01); *H01H 50/58* (2013.01); *H01H 51/01* (2013.01); *H01H 51/287* (2013.01)

(58) Field of Classification Search

CPC ..... H01H 45/02; H01H 45/10; H01H 51/01; H01H 51/287; H01H 50/32; H01H 50/56; H01H 50/58; H01H 50/321; H01H 50/18; H01H 50/041

USPC ..... 335/83

See application file for complete search history.

(56) References Cited

U.S. PATENT DOCUMENTS 4,258,344 A * 3/1981 Nishimi ..... H01H 50/54 335/129

4,302,742 A * 11/1981 Schedele ..... H01H 50/026 335/135

(Continued)

FOREIGN PATENT DOCUMENTS

JP 2013-196923 9/2013

*Primary Examiner* — Shawki S Ismail
*Assistant Examiner* — Lisa N Homza
(74) *Attorney, Agent, or Firm* — IPUSA, PLLC

(57) ABSTRACT

An electromagnetic relay includes an electromagnet, an armature configured to shift in response to a magnetic force generated by the electromagnet, a movable spring having a movable contact disposed thereon, a fixed spring including a first contact strip and a second contact strip, the first contact strip having a first fixed contact disposed thereon, the second contact strip having a second fixed contact disposed thereon, the first fixed contact and the second fixed contact facing the movable contact, and a linkage member configured to link the armature and the movable spring to shift the movable spring in conjunction with movement of the armature.

6 Claims, 5 Drawing Sheets

(51) Int. Cl.
*H01H 51/01* (2006.01)
*H01H 51/28* (2006.01)

(56) References Cited

U.S. PATENT DOCUMENTS 4,825,179 A * 4/1989 Nagamoto ..... H01H 50/26 335/128
5,204,647 A * 4/1993 Mitsuki ..... H01H 50/043 335/128
5,864,270 A * 1/1999 Hoffman ..... H01H 50/026 335/128
5,907,268 A * 5/1999 Mader ..... H01H 50/042 335/130
6,144,270 A * 11/2000 Mader ..... H01H 50/24 335/78
6,781,490 B2 * 8/2004 Funayama ..... H01H 50/026 335/78
7,477,119 B2 * 1/2009 Wu ..... H01H 50/043 335/128
7,750,769 B2 * 7/2010 Minowa ..... H01H 50/56 335/128
8,111,117 B2 * 2/2012 Minowa ..... H01H 50/28 335/129
8,193,881 B2 * 6/2012 Yuba ..... H01H 9/443 335/128
8,305,166 B2 * 11/2012 Kojima ..... H01H 50/043 335/78
8,354,906 B2 * 1/2013 Nagura ..... H01H 9/443 335/128
8,373,524 B1 * 2/2013 Villarin ..... H01H 1/225 335/78
8,493,164 B2 * 7/2013 Kurihara ..... H01H 50/047 335/78
8,525,622 B2 * 9/2013 Kubono ..... H01H 50/14 335/199
8,922,307 B2 * 12/2014 Fujimoto ..... H01H 50/026 335/129
9,007,156 B2 * 4/2015 Hiraiwa ..... H01H 9/443 335/78
9,076,617 B2 * 7/2015 Yamashita ..... H01H 9/40
9,082,575 B2 * 7/2015 Yamashita ..... H01H 9/443
9,123,494 B2 * 9/2015 Shinkai ..... H01H 51/06
9,136,080 B2 * 9/2015 Sumino ..... H01H 50/20
9,202,653 B2 * 12/2015 Sakai ..... H01H 51/06
9,401,256 B2 * 7/2016 Fujimoto ..... H01H 50/36
9,437,382 B2 * 9/2016 Kato ..... H01F 5/04
9,960,002 B2 * 5/2018 Kohinata ..... H01H 50/36
2010/0109821 A1 * 5/2010 Takano ..... H01H 50/047 335/202
2014/0203898 A1 * 7/2014 Li ..... H01H 50/641 335/189
2017/0221663 A1 * 8/2017 Kohinata ..... H01H 50/36
2018/0012717 A1 * 1/2018 Kohinata ..... H01H 45/02

* cited by examiner

ELECTROMAGNETIC RELAY

BACKGROUND OF THE INVENTION

1. Field of the Invention

The disclosures herein relate to an electromagnetic relay.

2. Description of the Related Art

An electromagnetic relay is used as a device for switching between a current conducting state and a current non-conducting state. An electromagnetic relay has a movable contact facing a fixed contact and moving in response to a magnetic field generated by an electromagnet, so that the movable contact makes and breaks a contact with the fixed contact, thereby conducting or stopping electrical current.

A foreign material caught between the movable contact and the fixed contact of the electromagnetic relay may cause electrical conduction failure due to the inability of the movable contact to come in contact with the fixed contact. In consideration of this, there is a type of contact structure of an electromagnetic relay that utilizes a plurality of fixed contacts disposed to face a movable contact, thereby allowing at least one of the plurality of fixed contacts to be in contact with the movable contact despite the presence of a foreign material (see Patent Document 1, for example).

However, the contact structure of an electromagnetic relay disclosed in Patent Document 1 may also suffer electrical conduction failure because a foreign material caught between one of the fixed contacts and the movable contact may cause the remaining fixed contacts to fail to make a contact with the movable contact.

Accordingly, there may be a need to provide an electromagnetic relay that has a lower likelihood of contact failure between contacts caused by foreign material.

[Patent Document 1] Japanese Patent Application Publication No. 2013-196923

SUMMARY OF THE INVENTION

It is a general object of the present invention to provide an electromagnetic relay that substantially obviates one or more problems caused by the limitations and disadvantages of the related art.

According to an embodiment, an electromagnetic relay includes an electromagnet, an armature configured to shift in response to a magnetic force generated by the electromagnet, a movable spring having a movable contact disposed thereon, a fixed spring including a first contact strip and a second contact strip, the first contact strip having a first fixed contact disposed thereon, the second contact strip having a second fixed contact disposed thereon, the first fixed contact and the second fixed contact facing the movable contact, and a linkage member configured to link the armature and the movable spring to shift the movable spring in conjunction with movement of the armature.

BRIEF DESCRIPTION OF THE DRAWINGS

Other objects and further features of the present invention will be apparent from the following detailed description when read in conjunction with the accompanying drawings, in which.

DESCRIPTION OF THE PREFERRED EMBODIMENTS

In the following, embodiments will be described by referring to the accompanying drawings. In these drawings, the same elements are referred to by the same references, and a description thereof may be omitted.

Figure 1:
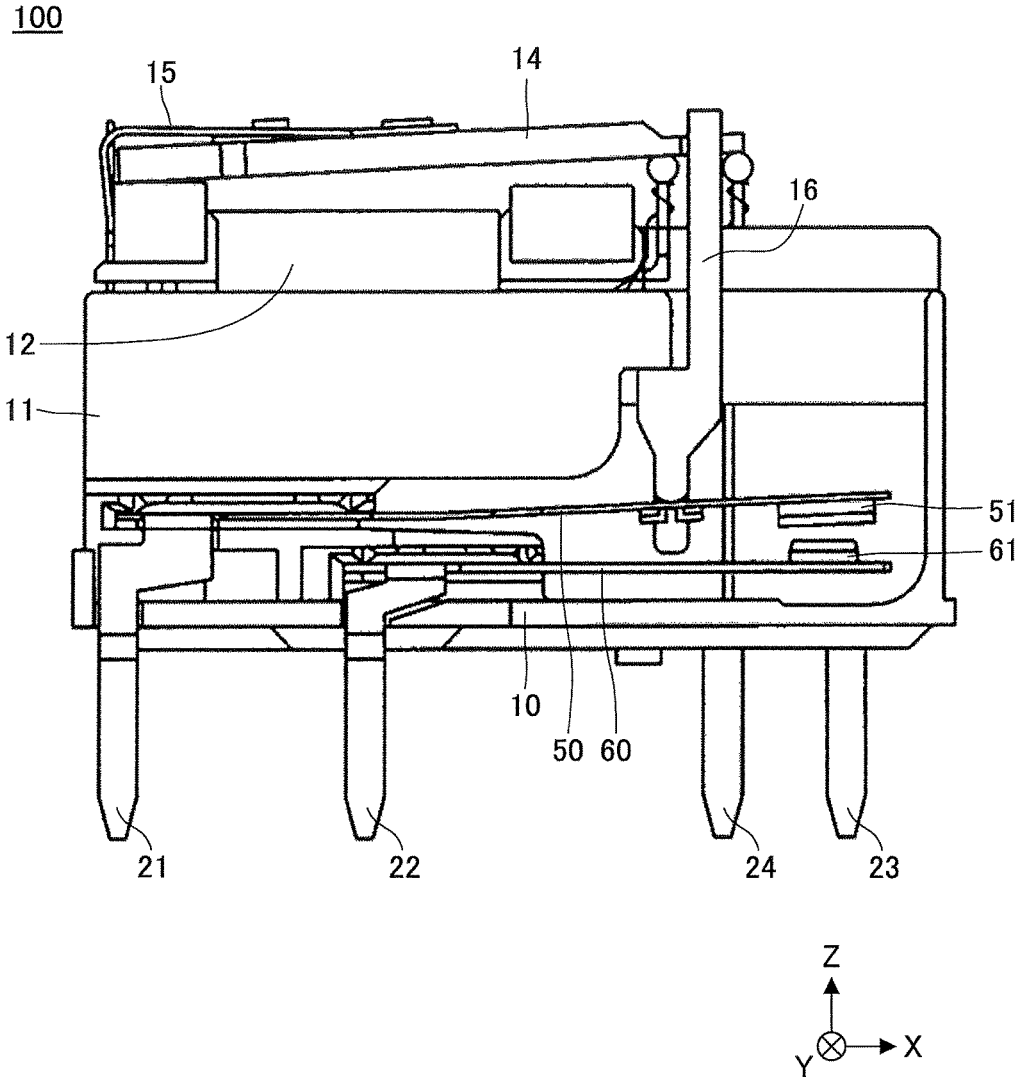
FIG. 1 is a schematic cross-sectional diagram illustrating an example of an electromagnetic relay according to an embodiment.

FIG. 1 is a drawing illustrating an example of an electromagnetic relay 100 according to an embodiment. FIG. 1 illustrates a side elevation view of the electromagnetic relay 100 without a cover case. In this and subsequent drawings, the X direction represents the width direction of the electromagnetic relay 100, and the Y direction represents the depth direction, with the Z direction representing the height direction.

As illustrated in FIG. 1, the electromagnetic relay 100 includes a base 10, an electromagnet 12, an armature 14, a card 16 (i.e., linkage member), a movable-contact spring 50, a movable contact 51, a fixed-contact spring 60, and a fixed contact 61.

The base 10, which is made of insulating resin material, includes a support part 11 for supporting the electromagnet 12. The electromagnet includes an iron core, a coil, and a case covering the iron core and the coil. The case is mounted on the support part 11. The coil of the electromagnet 12 is coupled to coil terminals 23 and 24. The electromagnet 12 generates a magnetic force when current is conducted to the coil via the coil terminals 23 and 24, and stops generating a magnetic force when the current to the coil is stopped.

The armature 14 is a plate-shaped member made of a magnetic material. The armature 14 has one end thereof secured to a flat spring 15 and the other end thereof connected to the card 16. The flat spring 15 is fixedly attached to the base 10 to urge the armature 14 away from the electromagnet 12.

The armature 14, which moves around one end thereof serving as a pivot point, is pulled toward the electromagnet 12 generating a magnetic force in response to current being conducted to the coil. The armature 14 thus shifts toward the electromagnet 12 (i.e., the right hand end thereof shifts downwardly in FIG. 1), resisting the urge exerted by the flat spring 15. Further, as the electromagnet stops generating a magnetic force upon the stoppage of current to the coil, the armature 14 urged by the flat spring 15 shifts away from the electromagnet 12 (i.e., the right hand end thereof shifts upwardly in FIG. 1).

The card 16, which is made of insulating resin material, serves as a link between the armature 14 and the movable-contact spring 50. The card 16 has one end thereof connected to the armature 14 and the other end thereof connected to the movable-contact spring 50. The card 16 moves upwardly and downwardly in FIG. 1 in conjunction with the movement of the armature 14.

A shift of the armature 14 toward the electromagnet 12 causes the card 16 to shift downward in FIG. 1, thereby pushing the movable-contact spring 50 toward the fixed-contact spring 60. A shift of the armature 14 away from the electromagnet 12 causes the card 16 to shift upward in FIG. 1, thereby moving the movable-contact spring 50 away from the fixed-contact spring 60.

The movable-contact spring 50 is a plate-shaped member made of electrically conductive material. The movable-contact spring 50 has one end thereof secured to the base 10 and coupled to a contact terminal 21. The other end of the movable-contact spring 50 has the movable contact 51 disposed thereon. The movable contact 51 is disposed on the surface of the movable-contact spring 50 on the same side as the fixed-contact spring 60 to face the fixed contact 61.

The fixed-contact spring 60 is a plate-shaped member made of electrically conductive material. The fixed-contact spring 60 has one end thereof secured to the base 10 and coupled to a contact terminal 22. The other end of the fixed-contact spring 60 has the fixed contact 61 disposed thereon. The fixed contact 61 is disposed on the surface of the fixed-contact spring 60 on the same side as the movable-contact spring 50 to face the movable contact 51.

The armature 14 shifting toward the electromagnet 12 pushes the card 16 downwardly in FIG. 1, which pushes the movable-contact spring 50 toward the fixed-contact spring 60, resulting in the movable contact 51 being in contact with the fixed contact 61. As the movable contact 51 and the fixed contact 61 are in contact with each other, the contact terminals 21 and 22 are electrically coupled to each other.

The armature 14 shifting away from the electromagnet 12 pulls the card 16 upwardly in FIG. 1, which pulls the movable-contact spring 50 away from the fixed-contact spring 60, resulting in the movable contact 51 being separated from the fixed contact 61. As the movable contact 51 and the fixed contact 61 are separated from each other, the contact terminals 21 and 22 are electrically isolated from each other.

Figure 2:
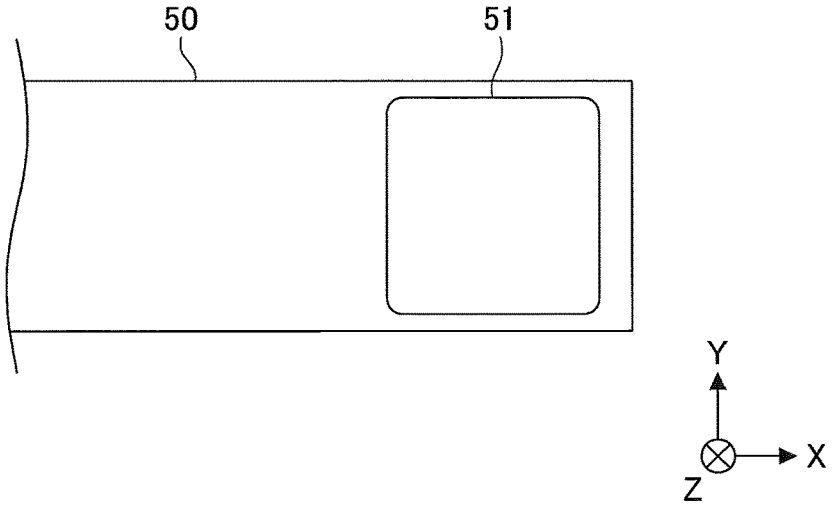
FIG. 2 is a drawing illustrating an example of a movable-contact spring and a movable contact according to the embodiment.

FIG. 2 is a drawing illustrating an example of the movable-contact spring 50 and the movable contact 51 according to the embodiment.

As is illustrated in FIG. 2, the free end of the movable-contact spring 50 (i.e., the right hand end in FIG. 1) has the movable contact 51 disposed thereon.

Figure 3:
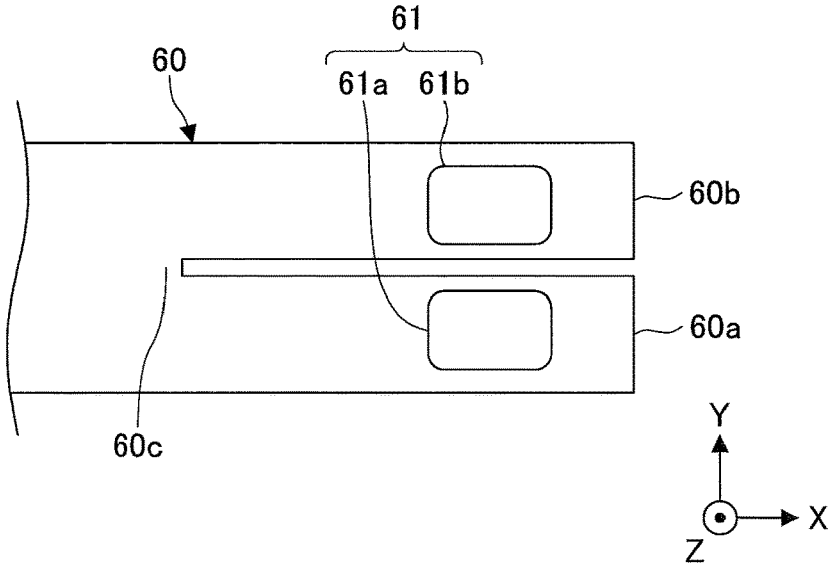
FIG. 3 is a drawing illustrating an example of a fixed-contact spring and a fixed contact according to the embodiment.

FIG. 3 is a drawing illustrating an example of the fixed-contact spring 60 and the fixed contact 61 according to the embodiment.

As is illustrated in FIG. 3, the free end of the fixed-contact spring 60 (i.e., the right hand end in FIG. 1) is formed into a first contact strip 60*a* and a second contact strip 60*b*, each of which branches from a branch point 60*c* to extend in the X direction. The first contact strip 60*a* and the second contact strip 60*b* are configured to be elastically deformable independently of each other. The first contact strip 60*a* has a first fixed contact 61*a* disposed thereon. The second contact strip 60*b* has a second fixed contact 61*b* disposed thereon.

The fixed contact 61 is a pair of twin contacts which are the first fixed contact 61*a* disposed on the first contact strip 60*a* and the second fixed contact 61*b* disposed on the second contact strip 60*b*. Both the first fixed contact 61*a* and the second fixed contact 61*b* are configured to come in contact with the movable contact 51. The first fixed contact 61*a* and the second fixed contact 61*b* may hereinafter be referred to as the fixed contacts 61*a* and 61*b*.

Figure 4B:
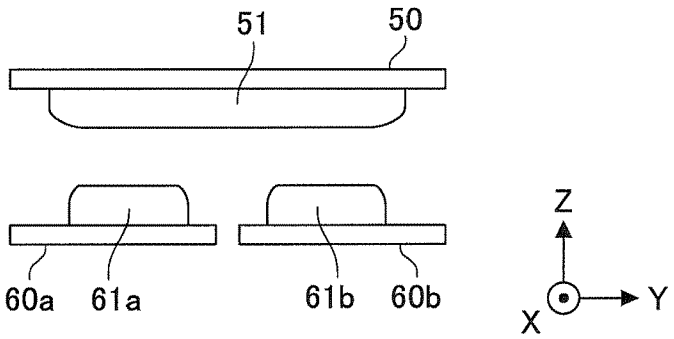
FIGS. 4A and 4B are drawings illustrating an example of the way in which the movable contact is separated from the fixed contacts.
Figure 4A:
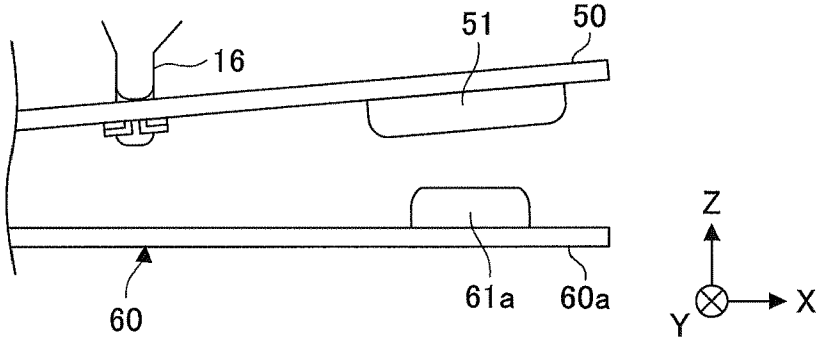

FIGS. 4A and 4B are drawings illustrating an example of the way in which the movable contact 51 is separated from the fixed contacts 61*a* and 61*b*. FIG. 4A is a side view, and FIG. 4B is a front view.

In the case of the electromagnet 12 being not excited, the armature 14 urged by the flat spring 15 is separated from the electromagnet 12. In this state, the card 16 is pulled upward in the Z direction by the armature 14, thereby separating the movable-contact spring 50 from the fixed-contact spring 60 as illustrated in FIGS. 4A and 4B, resulting in the movable contact 51 being separated from the fixed contacts 61*a* and 61*b*. Separation of the movable contact 51 from the fixed contacts 61*a* and 61*b* causes the contact terminals 21 and 22 to be electrically isolated from each other.

Figure 5B:
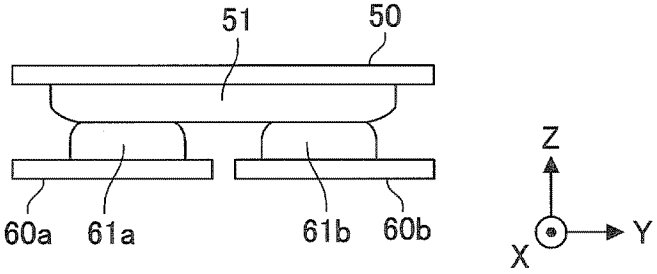
FIGS. 5A and 5B are drawings illustrating an example of the way in which the movable contact is in contact with the fixed contacts.
Figure 5A:
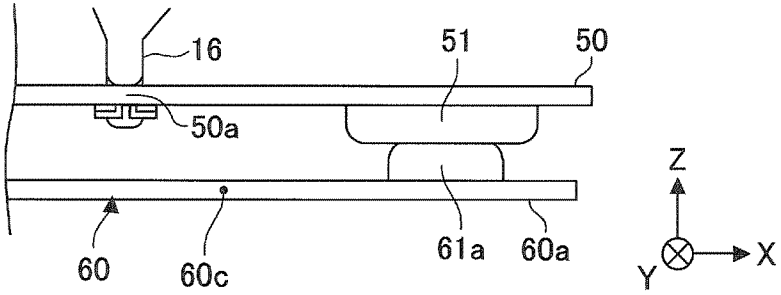

FIGS. 5A and 5B are drawings illustrating an example of the way in which the movable contact 51 is in contact with the fixed contacts 61*a* and 61*b*. FIG. 5A is a side view, and FIG. 5B is a front view.

In the case of the electromagnet 12 being excited, the armature 14 is pulled toward the electromagnet 12 against the urge exerted by the flat spring 15. The armature 14 shifting toward the electromagnet 12 pushes the card 16 downwardly in the direction opposite to the Z direction, which pushes the movable-contact spring 50 toward the fixed-contact spring 60 as illustrated in FIGS. 5A and 5B, resulting in the movable contact 51 being in contact with the fixed contacts 61*a* and 61*b*. Contact of the movable contact 51 with the fixed contacts 61*a* and 61*b* causes the contact terminals 21 and 22 to be electrically coupled to each other.

In the case of no foreign material being present between the movable contact 51 and the fixed contacts 61*a* and 61*b*, the movable contact 51 is in contact with both of the fixed contacts 61*a* and 61*b* as illustrated in FIG. 5B, so that the contact terminals 21 and 22 are electrically coupled to each other. In this state, the card 16 urges the movable-contact spring 50 at a point situated toward the end of the movable-contact spring 50 that is secured to the base 10. Specifically, the card 16 is in contact with the movable-contact spring 50 at a point situated further toward such an end of the movable-contact spring 50 than the position of the movable contact 51. More specifically, the card 16 (i.e., linkage member) is linked to a linkage point 50*a* of the movable-contact spring 50 wherein the linkage point 50*a* faces an area of the fixed-contact spring 60 situated between the branch point 60*c* and the fixed end of the fixed-contact spring 60. Namely, the linkage point 50*a* is situated between the branch point 60*c* and the fixed end of the fixed-contact spring 60 in a plan view taken in a direction in which the movable contact 51 moves.

In the electromagnetic relay 100 of the present embodiment, the movable contact 51 is capable of being in contact with the second fixed contact 61*b* despite the presence of a foreign material between the movable contact 51 and the first fixed contact 61*a*. Likewise, the movable contact 51 is capable of being in contact with the first fixed contact 61*a* despite the presence of a foreign material between the movable contact 51 and the second fixed contact 61*b*. In this manner, the electromagnetic relay 100 uses a single contact as the movable contact 51 and a pair of twin contacts as the fixed contact 61 to avoid contact failure caused by a foreign material, thereby enabling secure electrical conduction between the contact terminals 21 and 22.

Figure 6:
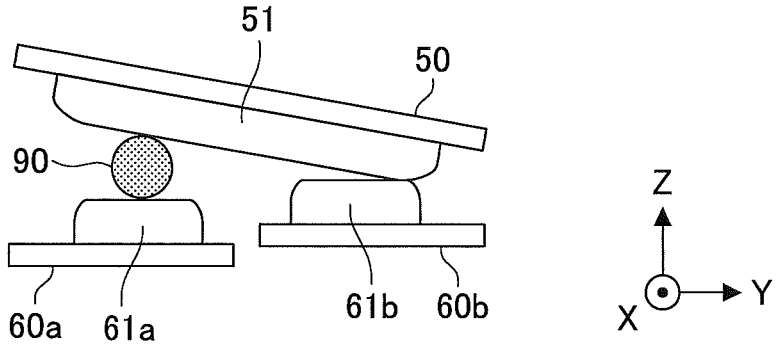
FIG. 6 is a drawing illustrating the way in which the movable is in contact with one of the fixed contacts in the presence of a foreign material.

FIG. 6 is a drawing illustrating the way in which the movable contact 51 is in contact with the second fixed contact 61*b* when a foreign material 90 is present between the movable contact 51 and the first fixed contact 61*a*.

In the case of the foreign material 90 being present between the movable contact 51 and the first fixed contact 61*a*, the movable-contact spring 50 pushed by the card 16 exert force on the first contact strip 60*a* with the foreign material 90 intervening between the movable contact 51 and the first fixed contact 61*a*. Since the card 16 pushes the movable-contact spring 50 at a point situated toward the end of the movable-contact spring 50 that is secured to the base 10, the movable-contact spring 50 being pushed by the card 16 while the foreign material 90 is present between the movable contact 51 and the first fixed contact 61*a* causes the movable-contact spring 50 to exhibit torsion as illustrated in FIG. 6. Moreover, the first contact strip 60*a* is pushed further downward than the second contact strip 60*b* because of the presence of the foreign material 90 as illustrated in FIG. 6.

The first contact strip 60*a* and the second contact strip 60*b* are formed as branches so as to be deformable independently of each other. Because of this, pushing the first fixed contact 61*a* while the foreign material 90 is present between the movable contact 51 and the first fixed contact 61*a* causes the first contact strip 60*a* to shift downward, but the second contact strip 60*b* does not follow the shift movement of the first contact strip 60*a*. In the case of the foreign material 90 being present between the movable contact 51 and the first fixed contact 61*a*, the shift of the first contact strip 60*a* pushed by the foreign material 90 is greater than the shift of the second contact strip 60*b*. As a result, the force exerted by the first contact strip 60*a* on the movable-contact spring 50 is greater than the force exerted by the second contact strip 60*b* on the movable-contact spring 50.

Moreover, the card 16 in the present embodiment is linked to the movable-contact spring 50 at a point between the movable contact 51 and the fixed end of the movable-contact spring 50 fixed to the base 10. The opposite end of the movable-contact spring 50 on the same side as the movable contact 51 is a free end that is neither fixed nor supported. Further, the card 16 urges the movable-contact spring 50 on the same side as the fixed end of the movable-contact spring 50 fixed to the base 10. Because of this, the movable-contact spring 50, which receives forces of different, respective magnitudes from the first contact strip 60*a* and the second contact strip 60*b* due to the presence of the foreign material 90 between the movable contact 51 and the first fixed contact 61*a*, exhibits a torsion-like deformation as illustrated in FIG. 6. This causes the movable contact 51 and the second fixed contact 61*b* to come in contact with each other. The movable-contact spring 50 is preferably configured to exhibit elastic torsion between the free end and the point at which the movable-contact spring 50 is pushed by the card 16.

In this manner, the movable contact 51 and the second fixed contact 61*b* come in contact with each other even when the foreign material 90 is present between the movable contact 51 and the first fixed contact 61*a*, for example, thereby establishing electrical conduction between the contact terminals 21 and 22. Similarly, the movable contact 51 and the first fixed contact 61*a* come in contact with each other even when the foreign material 90 is present between the movable contact 51 and the second fixed contact 61*b*, for example, thereby establishing electrical conduction between the contact terminals 21 and 22.

As described above, the electromagnetic relay 100 of the present embodiment ensures that the movable contact 51 come in contact with one of the fixed contacts 61*a* and 61*b* even when a foreign material prevents the movable contact 51 from making contact with the other one of the fixed contacts 61*a* and 61*b*, thereby avoiding contact failure. Accordingly, the possibility of contact failure occurring due to a foreign material is reduced.

According to at least one embodiment, an electromagnetic relay is provided that has a lower likelihood of contact failure between contacts caused by foreign material.

Although electromagnetic relay has heretofore been described according to the embodiments, the present invention is not limited to those embodiments. Various changes and modifications may be made without departing from the scope of the invention.

The present application is based on and claims the benefit of priority of Japanese priority application No. 2016-133523 filed on Jul. 5, 2016, with the Japanese Patent Office, the entire contents of which are hereby incorporated by reference.

What is claimed is:

1. An electromagnetic relay, comprising:

an electromagnet;

an armature configured to shift in response to a magnetic force generated by the electromagnet;

a movable spring having a movable contact disposed thereon;

a fixed spring including a first contact strip and a second contact strip, the first contact strip having a first fixed contact disposed thereon, the second contact strip having a second fixed contact disposed thereon, the first fixed contact and the second fixed contact facing the movable contact; and a linkage member configured to link the armature and the movable spring to shift the movable spring in conjunction with movement of the armature wherein the first contact strip and the second contact strip are configured to be elastically deformable independently of each other.

2. The electromagnetic relay as claimed in claim 1, wherein the linkage member is connected to a linkage point of the movable spring, the linkage point being situated between the movable contact and a fixed end of the movable spring, and the linkage point of the movable spring is situated between a fixed end of the fixed spring and a branch point of the fixed spring in a plan view taken in a direction in which the movable contact moves, the branch point being a point at which the fixed spring divides into the first contact strip and the second contact strip.

3. The electromagnetic relay as claimed in claim 1, wherein the fixed spring is a plate-shaped spring that has the fixed end and a free end, the fixed spring dividing into the first contact strip and the second contact strip toward the free end.

4. The electromagnetic relay as claimed in claim 3, wherein the movable spring is a plate-shaped spring that has a fixed end and a free end, the free end having the movable contact disposed thereon, and the movable spring is configured to exhibit elastic torsion between the fixed end and the free end.

5. The electromagnetic relay as claimed in claim 4, wherein the linkage member is configured to push the movable spring at a point situated between the movable contact and the fixed end of the movable spring.

6. The electromagnetic relay as claimed in claim 5, wherein the movable spring is configured to exhibit elastic torsion between the free end and the point at which the movable spring is pushed by the linkage member.

* * * * *